US010745970B2

(12) United States Patent
Liu

(10) Patent No.: US 10,745,970 B2
(45) Date of Patent: Aug. 18, 2020

(54) STEERABLE EARTH BORING ASSEMBLY WITH DIFFERENTIAL BRAKING

(71) Applicant: BITSWAVE INC., Sugar Land, TX (US)

(72) Inventor: Ce Liu, Sugar Land, TX (US)

(73) Assignee: BITSWAVE INC., Sugar Land ( * ) Notice: Subject to any disclaimer, the term of this patent is extended or adjusted under 35 U.S.C. 154(b) by 138 days.

(21) Appl. No.: 16/110,938

(22) Filed: Aug. 23, 2018

(65) Prior Publication Data

US 2020/0063496 A1 Feb. 27, 2020

(51) Int. Cl.

| | |
|---|---|
| ***E21B 7/06*** | (2006.01) |
| ***E21B 4/02*** | (2006.01) |
| ***E21B 17/16*** | (2006.01) |
| ***E21B 3/00*** | (2006.01) |
| ***E21B 7/04*** | (2006.01) |
| ***E21B 4/00*** | (2006.01) |

(52) U.S. Cl.

CPC ..... *E21B 7/064* (2013.01); *E21B 3/00* (2013.01); *E21B 4/02* (2013.01); *E21B 7/062* (2013.01); *E21B 17/16* (2013.01); *E21B 4/003* (2013.01); *E21B 7/046* (2013.01)

(58) Field of Classification Search

CPC . E21B 7/064; E21B 4/02; E21B 17/16; E21B 3/00; E21B 7/062; E21B 7/046; E21B 4/003; E21B 7/06; E21B 7/04; E21B 4/04

See application file for complete search history.

(56) References Cited

U.S. PATENT DOCUMENTS

| | | | | |
|---|---|---|---|---|
| 9,890,593 | B2 * | 2/2018 | Marshall | E21B 7/04 |
| 9,970,237 | B2 * | 5/2018 | Davis | E21B 7/04 |
| 2017/0002608 | A1 * | 1/2017 | Davis | E21B 7/067 |
| 2017/0002610 | A1 * | 1/2017 | Marshall | E21B 7/067 |

* cited by examiner

*Primary Examiner* — Wei Wang

(74) *Attorney, Agent, or Firm* — Bracewell LLP; James E. Bradley

(57) ABSTRACT

A steerable earth boring assembly which includes an annular collar and a drive shaft with a drill bit, where the shaft pivots with respect to the collar. An upper portion of the shaft inserts into an orientation sleeve which resides in the collar. An axial bore is obliquely formed through the orientation sleeve, and in which the upper portion inserts. An angular offset between the drive shaft and collar is changed by adjusting azimuthal positions of the orientation sleeve with respect to the collar. A brake assembly is included for applying a restraining force onto the orientation sleeve.

14 Claims, 14 Drawing Sheets

STEERABLE EARTH BORING ASSEMBLY WITH DIFFERENTIAL BRAKING

BACKGROUND OF THE INVENTION

1. Field of Invention

The present disclosure relates to a system for controlling a path of a drill bit in a subterranean formation. More specifically, the present disclosure relates to a drilling assembly that steers with differential braking.

2. Description of Prior Art

Earth boring drilling systems are typically used to form wellbores that intersect subterranean formations having hydrocarbons so that the hydrocarbons can be extracted from the formations. The drilling systems usually include a rotatable drill string having a drill bit on its lower end for excavating through the formation. The drill string and drill bit are typically rotated by either a top drive or rotary table provided on surface. The types of drill bits are usually either roller cone bits or drag bits; and where cutting elements are generally formed on the bits. The combination of axial pressure on the drill string, combined with drill string rotation, causes the cutting elements to excavate through the formation and form cuttings that are circulated back uphole with drilling fluid.

Non-vertical or deviated wellbores are sometimes formed by whipstocks that are disposed in the wellbore and deflect the bit and drill string along a designated path in the formation. Deviated wellbores are often formed using mud motors mounted onto the drill string, which have fixed or adjustable angle bent sub housings and, when used in a sliding only mode are selectively oriented to direct the bit along a chosen direction. Deviated wellbores are otherwise formed using rotary steerable systems, which provide a means of steerable drilling while also permitting most or all of the drill string to rotate during steering operations.

SUMMARY OF THE INVENTION

Disclosed is an example of a method of excavating in a formation, and which includes operating a steerable earth boring assembly that is made up of, an annular collar, a drive shaft rotationally coupled to the annular collar, a drill bit mounted to a downstream end of the drive shaft, an orientation sleeve having a bore that extends oblique to an axis of the drive shaft, and in which receives an end of the drive shaft distal from the drill bit. Further included in the example method is rotating the drive shaft and drill bit by rotating the collar, monitoring a path of the drill bit, and adjusting the path by retarding rotation of the orientation sleeve. Retarding rotation of the orientation sleeve involves applying a lateral force to an outer surface of the orientation sleeve. The lateral force is optionally applied for a period of time, and where the period of time relates to a rotational rate of the collar. In an alternative, a direction of the path is adjusted, optionally, an inclination of the path is adjusted. A brake is optionally included that is urged into contact with the orientation sleeve to retard rotation of the orientation sleeve. The method optionally includes rotating the orientation sleeve. The steerable earth boring assembly further includes a motor that is coupled to the orientation sleeve, and wherein the motor is made up of a stator, coils in the stator, a rotor circumscribing the stator and which is coupled to the orientation sleeve, the method further comprising rotating the rotor by energizing the coils.

Also disclosed herein is a steerable earth boring assembly, and which includes an annular collar that is selectively rotationally coupled to a drill string, an orientation sleeve having an axis and a bore that extends along a path oblique to the axis, a drive shaft rotationally coupled to the collar and that has a downstream end, and an upstream end that is inserted into the bore in the orientation sleeve. The assembly of this example also includes a drill bit mounted in the downstream end and a brake assembly having a pad that is selectively extended into contact with an outer surface of the orientation sleeve. A lateral force is optionally applied to the orientation sleeve by the pad and which changes a relative rate of rotation between the collar and the orientation sleeve. In an example, the pad is urged axially against an end of the orientation sleeve, or urged radially against an outer circumference of the orientation sleeve. A motor is optionally included that is rotationally coupled with the orientation sleeve. In an example, the motor includes a stator, a coil in the stator, and a magnetic rotor that circumscribes the stator and that are coupled to orientation sleeve, so that when the coil is energized, the rotor rotates with respect to the stator and causes the orientation sleeve to rotate.

BRIEF DESCRIPTION OF DRAWINGS

Some of the features and benefits of the present invention having been stated, others will become apparent as the description proceeds when taken in conjunction with the accompanying drawings, in which.

Figure 1C:
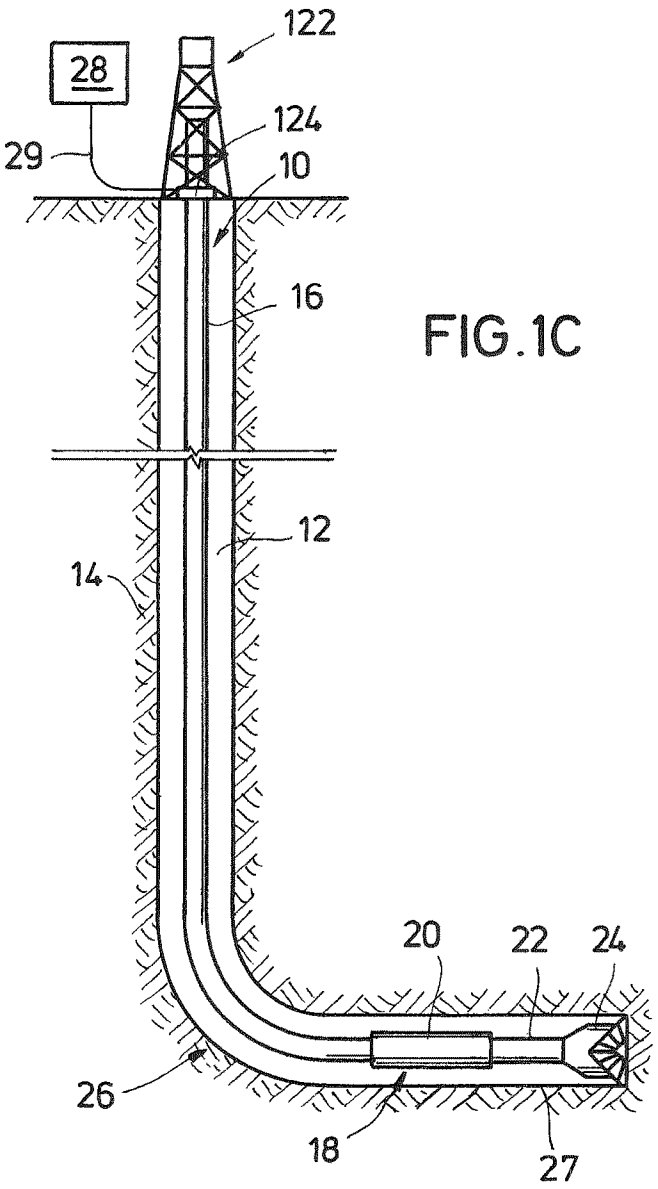
FIGS. 1A-1C are side partial sectional views of an example of a steerable earth boring assembly forming a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
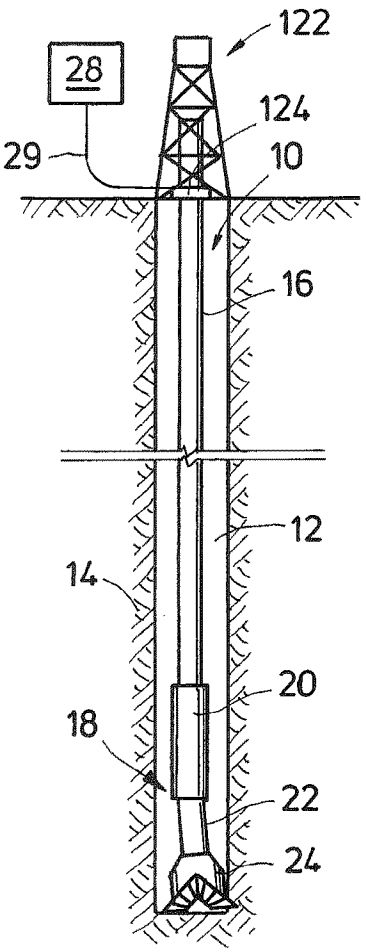
Figure 1A:
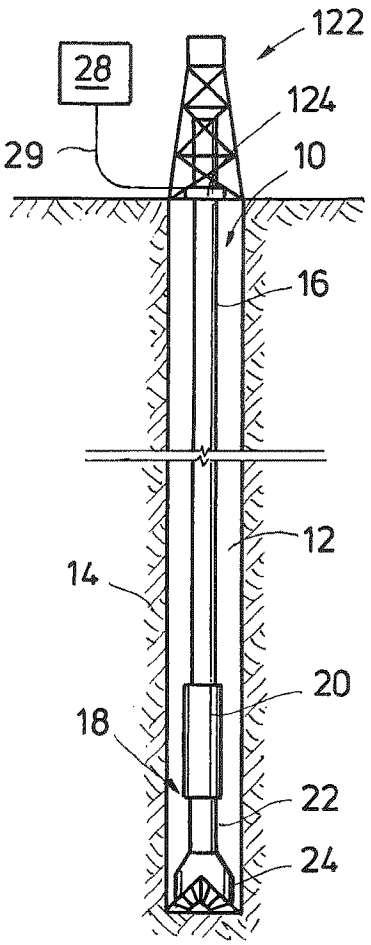

Shown in a side partial sectional view in FIG. 1A through 1C is one example of a drilling assembly 10 forming a wellbore 12. Wellbore 12 intersects a formation 14 and wherein drilling assembly 10 includes a rotating drill string 16 for delivering rotational power to form the wellbore 12. An example of a steering unit assembly ("SUA") 18 is shown mounted on the lower end of drill string, and which provides the cutting action to excavate the wellbore 12. Included within the example of the SUA 18 is a steering sub 20 which has an articulated sub 22 projecting from its downstream end. A drill bit 24 mounts on a lowermost end of articulated sub 22. As illustrated in FIG. 1B, articulated sub 22 is optionally pivoted so that it is oriented at an angle that is oblique with steering sub 20. Referring now to FIG. 1C, selectively pivoting the articulated sub 22 redirects the path of the SUA 18 so that a bend 26 is formed in wellbore 12. Downhole of the bend 26, the SUA 18 projects along a generally horizontal path as shown to thereby form a deviated portion 27 of the wellbore 12. Alternatively, deviated portion 27 is at an angle that is generally oblique with the vertical section of wellbore 12 shown uphole of bend 26.

An optional controller 28 shown on surface, which selectively communicates with the SUA 18; and in an example provides control signals or commands from surface to SUA 18, which the SUA 18 is configured to decode and perform a function in response to the control signal or command. Examples of communication include mechanical operations that generate signals downhole, such as by varying drill string rotation, varying mud flow rate, mud pulse telemetry, and combinations. In an alternative, a control line 29 is shown providing communication between controller 28 and SUA 18. Embodiments exist wherein control signals and feedback are transferred via control line 29. Alternatively, information regarding downhole conditions or operational parameters of the SUA 18 is transmitted to the controller 28.

Figure 2:
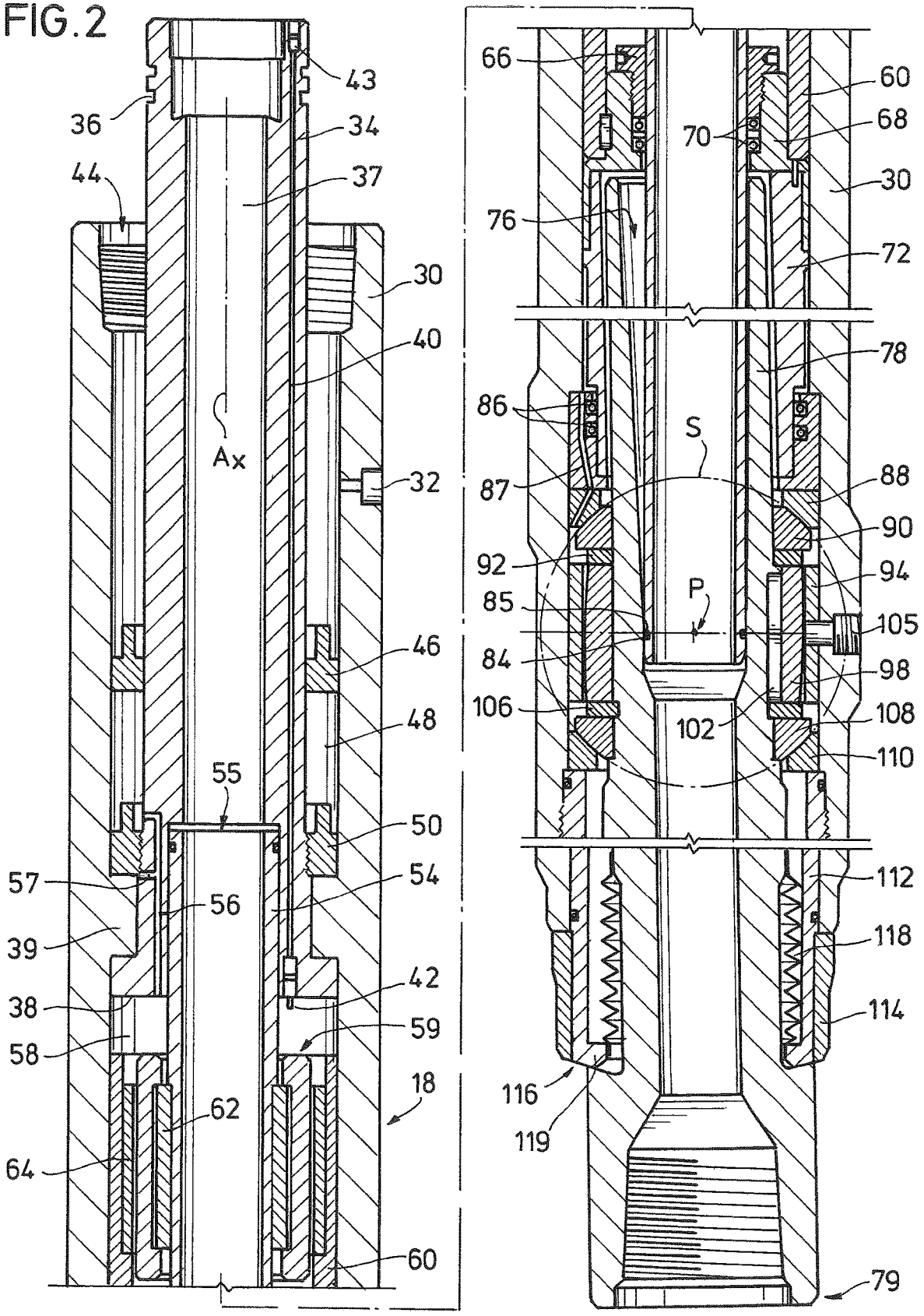
FIG. 2 is a side sectional view of an example of steering unit assembly for use with the earth boring assembly of FIGS. 1A-1C.

Provided in a side sectional view in FIG. 2 is one example of the SUA 18, and which includes an elongate annular member collar 30 on its outer surface. Collar 30 as shown provides a protective outer layer for components of the SUA 18. A port 32 is shown formed radially through the housing of collar 30. In an alternative, collar 30 includes selective profiles on its inner surface for the coupling of the components within SUA 18. An annular and elongate housing 34 is shown inserted within the annular space of collar 30 and having an end that projects axially out from an upstream end of collar 30. Grooves 36 circumscribe an outer surface of housing 34 at its upstream end, i.e. the end closer to the opening of wellbore 12 (FIGS. 1A-1C) when the SUA 18 is in the wellbore 12. In an example, grooves 36 provide coupling to drill string 16 (FIG. 1A through 1C); and the annular space 37 inside of housing 34 selectively receive drilling fluid (not shown) therein which is circulated within drill string 16.

A flange-like ledge 38 is depicted formed on a downstream end of housing 34 that is disposed within collar 30. Ledge 38 projects radially outward a distance from the lower terminal end of housing 34. A projection 39 is illustrated adjacent a lower end of ledge 38. Projection 39 is formed where an inner diameter of collar 30 reduces along a portion of its axial length. An upstream radial surface of ledge 38 abuts a downward-facing radial surface of a projection 39, so that projection 39 provides an axial stop thereby preventing relative upward movement of housing 34 with respect to collar 30. Axially formed through a sidewall of housing 34 is a passage 40, which extends the length of housing 34. Sealed feed through connectors 42, 43 are provided respectively at the downstream and upstream ends of passage 40. As will be described in more detail below, passage 40 allows for the wired communication between connector 42 and 43. Connector 42 prevents ingress of dielectric fluid contained in collar 30.

Still referring to FIG. 2, an outer diameter of housing 34 is shown spaced radially inward from an inner diameter of the inner surface of collar 30, an annulus 44 is formed between these members that extends along a portion of the axis of the housing 34. A ring-like piston 46 is shown inserted within annulus 44 and which is axially moveable within annulus 44. An annular chamber 48 is defined in the annulus 44 on a side of piston 46 distal from grooves 36. An annular nut 50 is shown in chamber 48 and landed on an upstream radial surface of projection 39. Nut 50 of FIG. 2 is coupled to an outer surface of housing 34.

An annular flow tube 54 is shown disposed within collar 30 and having an upstream end 55 (FIG. 3) that inserts into a lower portion of the annular space 37 that extends through housing 34. A diameter of the annular space 37 projects radially outward proximate ledge 38 to accommodate insertion of the upstream end 55. A passage 56 is shown extending axially through the sidewall of housing 34 adjacent upstream end 55. An upstream end of passage 56 projects radially outward and into fluid communication with chamber 48. Optionally, a port 57 projects radially outward from passage 56 through housing 34 to its outer surface. A downstream end of passage 56 opens into a chamber 58 that is in an annular space between flow tube 55 and an inner surface of collar 30. In this example, piston 46 in combination with chambers 48, 58 and passage 56, provide a pressure compensation means for pressurizing the space within chamber 58 to that of ambient. In an example of operation, piston 46 moves within annulus 44 in response to changing ambient pressures; such as when ambient pressures exceed pressure in chamber 58, piston 46 is urged downward thereby pressurizing fluid in chambers 48, 58 and passage 56, until pressure in chambers 48, 58 and passage 56 is substantially equal to ambient pressure. Further in this example, when ambient pressure is less than that in chambers 48, 58 and passage 56, piston 46 is urged upward in annulus 44 to relieve pressure in chambers 48, 58 and passage 56 until equal to ambient. In one example, port 57 communicates fluid between passage 56 and inside of nut 50 thereby equalizing pressure on a lower end of nut 50 to that within chamber 48.

Included within chamber 58 is an example of a motor assembly 59, which includes an annular rotor 60 set on an outer radial portion of chamber 58 and extending along an axial portion of chamber 58. A stator 62 is illustrated set radially within rotor 60, which also is annular and within chamber 58. A magnet rotor 64, which in the example shown is an elongate ring-like array of permanent magnets, is disposed between rotor 60 and stator 62 and coupled to the inner radial surface of rotor 60. In an example of operation, the motor assembly 59 operates when a control signal is supplied from a control unit, such as within controller 28 (FIG. 1A/B), through the connectors 42,43 to the stator 62. In this example, the control signal energizes a set of coils (not shown) integral to the stator 62, which then imparts a rotational motive force on the magnet rotor 64. The resulting rotational movement of the magnet rotor 64 in turn results in rotational movement of the rotor 60. Below motor assembly 59 is a ring-like retaining nut 66 which axially threads to an inner surface of a collar-like flow tube positioner 68, and which provides an axial stop for flow tube 54. As shown in FIG. 2, bearings 70 are provided between flow tube 54 and flow tube positioner 68. In the illustrated example, bearings 70 are shown as roller-type bearings and provide relative rotation between flow tube positioner 68 and flow tube 54. However, other types of bearings can be used in this application, including journal bearings, as well as a thin film of lubricant. A turbine and controller (not shown) is optionally included with SUA 18, turbine is rotatable in response to drilling fluid flowing down drill string 16 and selectively generates electrical power for operating motor assembly 59.

Still referring to FIG. 2, an orientation sleeve 72 is shown mounted to a downstream end of flow tube positioner 68. Orientation sleeve 72 is a generally annular member that has a substantially cylindrical outer surface and projects axially away from motor assembly 59 and within collar 30. Rotor 60 is coupled to flow tube positioner 68, thus energizing motor assembly 59 causes rotation of rotor 60, that in turn produces selective rotation of flow tube positioner 68 and orientation sleeve 72.

Figure 4:
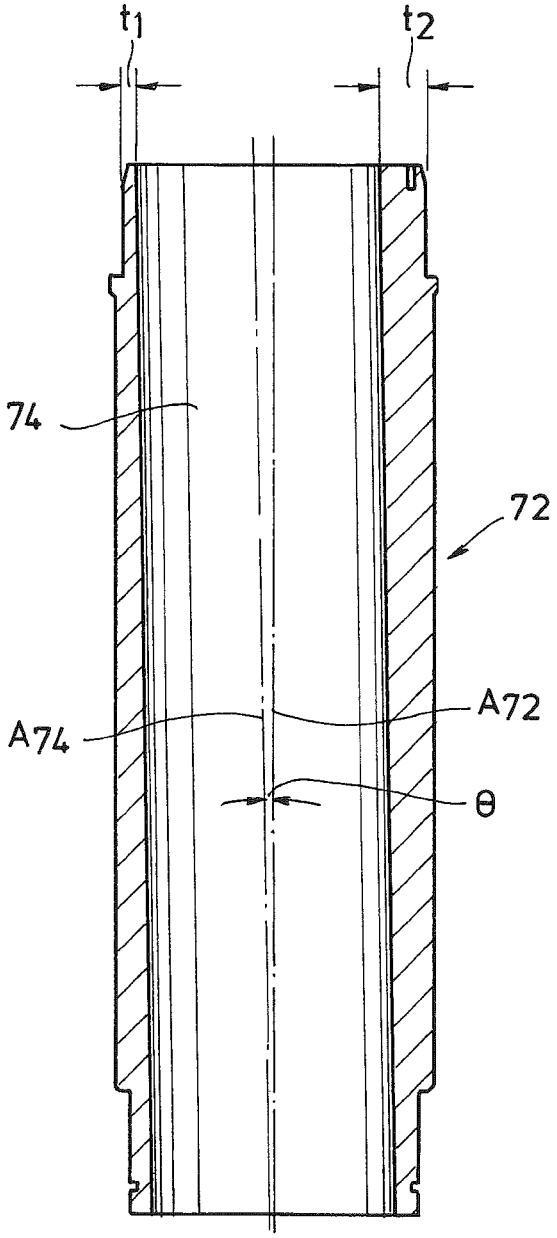
FIG. 4 is a side sectional perspective view of an example of an orientation sleeve collar for use with the steering unit assembly of FIG. 2.

Referring now to FIG. 4, orientation sleeve 72 is shown in a side perspective cut away view. A bore 74 extends axially through orientation sleeve 72 of FIG. 4; and which has an axis $A_{74}$ that projects along a path that is at an angle θ which is oblique to an axis $A_{72}$ of orientation sleeve 72. Bore 74 is optionally offset within orientation sleeve 72, so that axis $A_{74}$ oblique to axis $A_{72}$, and set radially apart from axis $A_{72}$ at opposing ends of orientation sleeve 72. To better illustrate the radially set apart axes $A_{72}$, $A_{74}$, a sidewall thickness $t_1$ of sleeve 72 at one azimuthal location is less than a sidewall thickness $t_2$ at an angularly spaced apart location.

Figure 3:
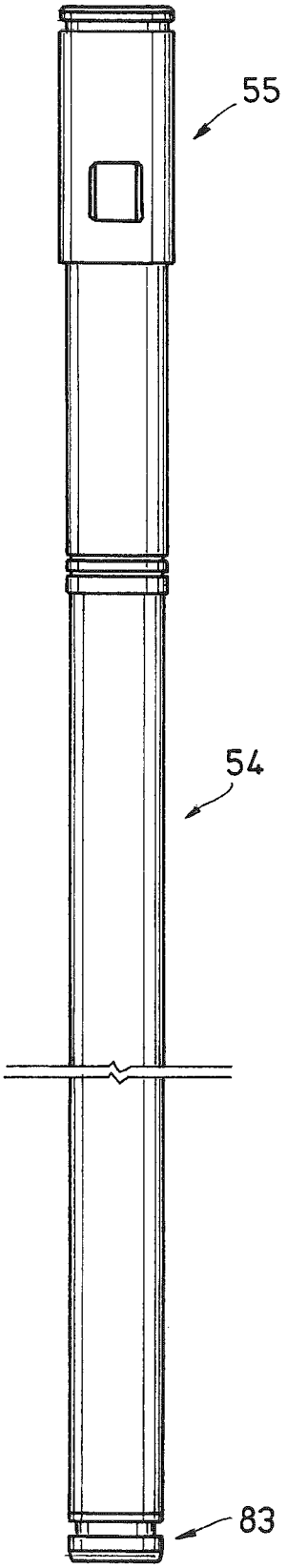
FIG. 3 is a side view of an example of a flow tube for use with the steering unit assembly of FIG. 2.
Figure 5:
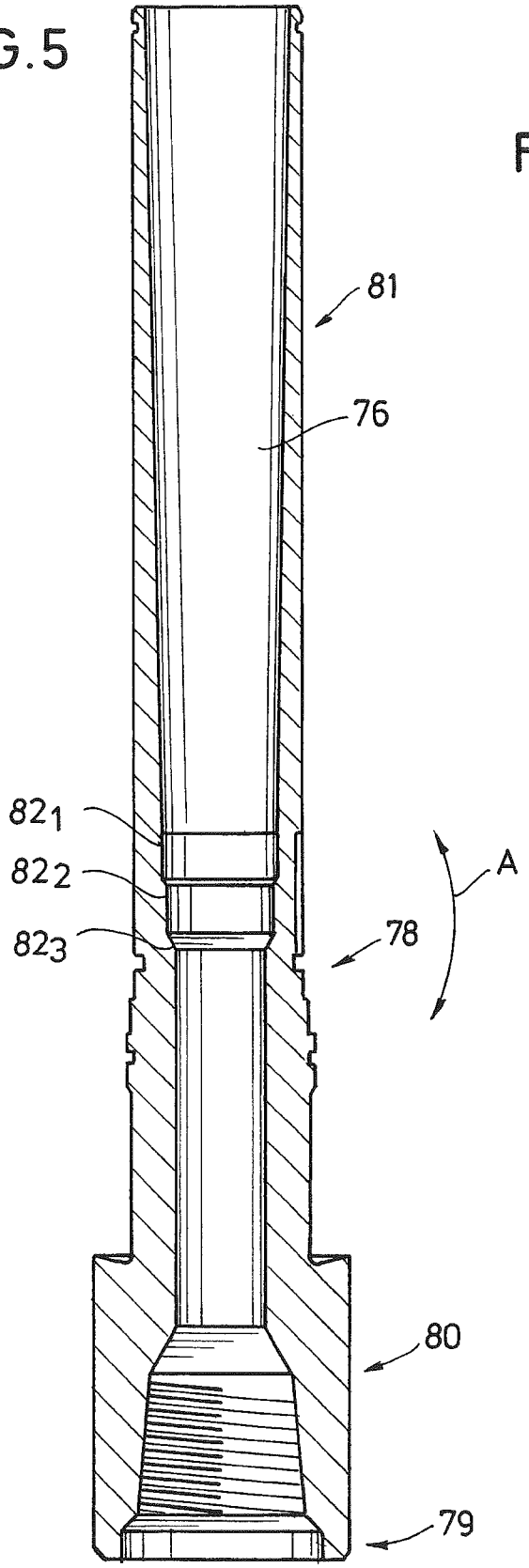
FIG. 5 is a side sectional perspective view of an example of a drive shaft for use with the steering unit assembly of FIG. 2.

Referring back to FIG. 2, a downstream end of flow tube 54 is shown inserted into a bore 76 that projects axially through a drive shaft 78. As will be described in more detail below, strategic axial positioning of the flow tube 54 creates a static seal on an end of the flow tube 54 and drive shaft 78. Illustrated in FIG. 5 is a side sectional view of one example of drive shaft 78. In this example, the diameter of bore 76 increases proximate the downstream end of drive shaft 78 to define a receptacle 79, that as shown in FIG. 1 selectively receives drill bit 24 for excavating wellbore 12. A portion of the drive shaft 78 having the receptacle 79 defines a base portion 80, wherein an outer diameter of base portion 80 projects radially outward above the upstream end of receptacle 79. A portion of drive shaft 78 distal from receptacle 79 defines a shroud portion 81; the diameter of bore 76 adjacent shroud portion 81 increases with proximity to its upstream end. As described below, drive shaft 78 is pivotable about its mid-portion, thus the strategic dimensioning of the diameter of bore 76 within shroud portion 81 allows a pivoting action around flow tube 54; so that the inner surface of bore 76 remains out of interfering contact with the outer surface of flow tube 54 as the drive shaft 78 is being pivoted. Further shown in FIG. 5 are a series of profiled sections $\mathbf{82}_1$-$\mathbf{82}_3$ in bore 76 that are formed where the diameter of bore 76 changes to form these profiles $\mathbf{82}_1$-$\mathbf{82}_3$. Profile $\mathbf{82}_2$ is strategically formed to be in contact with an O-ring 84 that is set in a recess 85 circumscribing a portion of flow tube 54 proximate its lower end 83 (FIG. 3). The O-ring 84 defines a static seal between the flow tube 54 and drive shaft 78. Thus when the drive shaft 78 pivots along the path represented by curved arrow A, a static seal is maintained between O-ring 84 and profile $\mathbf{82}_2$. It should be pointed out that the pivoting motion of drive shaft 78 relative to collar 30 is not limited to motion in a single plane, but includes swiveling where the relative movement between drive shaft 78 and collar 30 occurs across more than one plane. In an example, swiveling motion resembles a precession type motion. An advantage of the static seal along O-ring 84 is that the need for a seal that rotates or is otherwise dynamic is eliminated, as the static interface between the lower end 83 and profile $\mathbf{82}_2$ defines a flow barrier that blocks fluid flow passage from within flow tube 54 and bore 76 to outside of drive shaft 78. Accordingly, any fluid flowing within flow tube 54 from drill string 16 (FIGS. 1A through 1C) will not make its way between flow tube 54 and the inner surface of bore 76, but instead will continue within bore 76 downstream of profile $\mathbf{82}_3$ and towards receptacle 79.

Referring back to FIG. 2, a bearing assembly 86 is shown provided on an inner surface of collar 30, radially adjacent an outer surface of orientation sleeve 72, and axially proximate the lower end of orientation sleeve 72. Bearing assembly 86 reduces rotational friction as orientation sleeve 72 rotates within collar 30. Bearing assembly 86 is shown as a roller-type bearing assembly, but can instead be a journal type, as well as a thin floating film-type. A ring-like bearing shoulder ring 87 is shown just below bearing assembly 86 and generally coaxial with bearing assembly 86. Thus the outer surface of bearing shoulder ring 87 is in close contact with an inner surface of collar 30, and wherein ring 87 provides axial support for bearing assembly 86. Ring 87 has a wedge-like cross-section whose thickness increases with distance away from bearing assembly 86. The respective lower ends of ring 87 and orientation sleeve 72 are positioned at roughly the same axial location within collar 30. A ring-like spherical bearing outer race 88, which is also in the annular space between collar 30 and drive shaft 78, is set on a lower end of ring 87. Outer race 88 is in selective rotating contact with a spherical bearing inner race 90 shown mounted on an outer circumference of drive shaft 78. The contact surfaces between races 88, 90 run along a path that is oblique to an axis Ax of collar 30 and project radially outward with distance away from a lower end of orientation sleeve 72.

Figure 6:
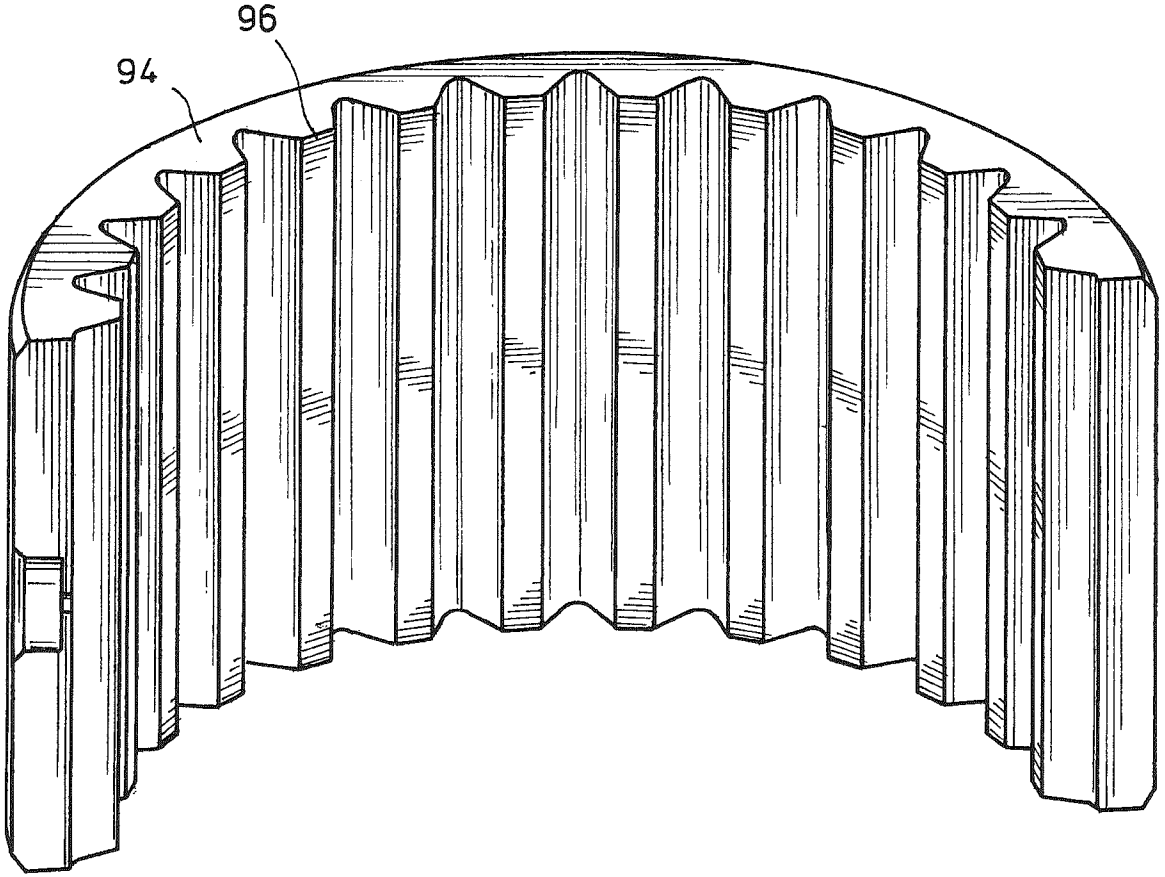
FIG. 6 is a perspective view of an example of a female spline for use with the steering unit assembly of FIG. 2.
Figure 7:
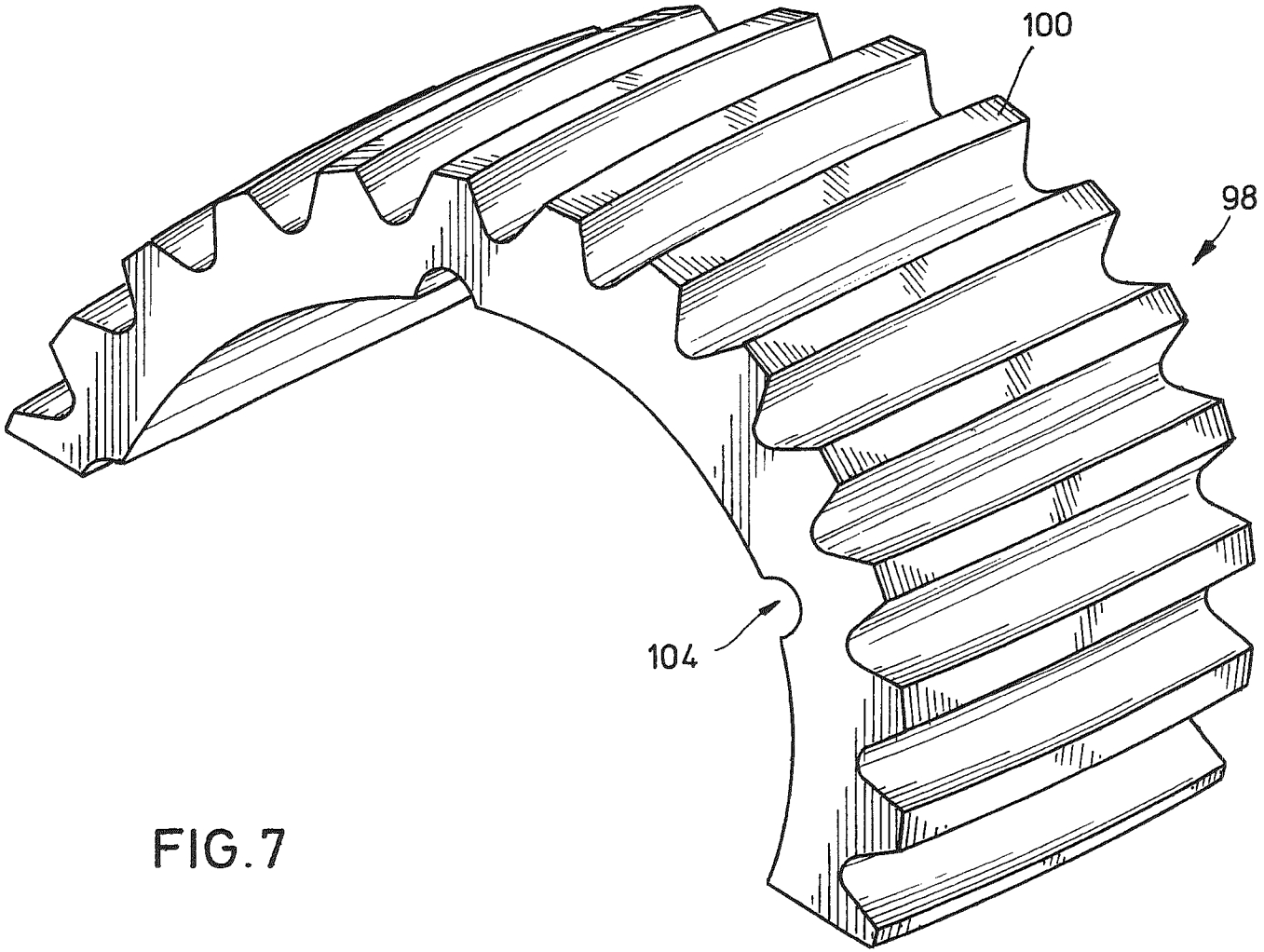
FIG. 7 is a perspective view of an example of a male spline for use with the steering unit assembly of FIG. 2.

A ring-like load spacer bearing 92 is shown on a lower end of race 90. Shown spaced axially downward from load spacer bearing 92 is an annular female spline 94 that is coupled to an inner surface of collar 30 along its inner circumference. Female spline 94 is alternatively is up of multiple sections that are mounted within collar 30. Shown in perspective view in FIG. 6 is an example of the female spline 94 having spline members 96 that project radially inward from an inner surface of female spline 94. Spline members 96 as shown are elongate members having their elongate lengths extending axially on the female spline 94. Spline members 96 are generally raised members at angularly spaced apart locations that resemble gear teeth. Referring back to FIG. 2, a male spline 98 is shown that is in selective engagement with female spline 94. Male spline 98 is also annular, and as shown in FIG. 7 includes corresponding spline members 100 that project radially outward, and extend axially along an outer radial surface of male spline 98. Spline members 100 selectively mesh into recesses between adjacent spline members 96 of female spline 94 (FIG. 6). Optionally, spline members 100 are involute having widths greater at their mid portions than at their ends. Rotation of one of the female or male splines 94, 98 necessarily causes rotation of the other spline 94, 98 and in the same rotational direction. In this fashion, rotation of the collar 30 via the drill string 26 (FIGS. 1A through 1C) causes corresponding rotation of the drive shaft 78. In the cutaway view of FIG. 2, a dowel 102, which is a pin-like member, extends axially within an opening 104 (FIG. 7) shown formed axially along an inner surface of the male spline 98. Further in the illustrated example, dowel 102 is coupled with the outer surface of drive shaft 78 to rotationally attach drive shaft 78 and male spline 98. In an alternative, threaded fasteners 105 are illustrated to attach female spline 94 to collar 30; so that when collar 30 is rotated, female spline 94 rotates in the same direction. Another dowel (not shown), similar to dowel 102, retains female spline 94 to collar 30.

Still referring to FIG. 2, a thrust ring 106 is shown set in a lower end of male spline 98 and which circumscribes drive shaft 78. Just below ring 106 are inner and outer races 108, 110 which contact one another along an oblique interface and which are similar in construction with races 88, 90. The oblique interfaces between races 88, 90 and races 108, 110 allow for relative pivoting of drive shaft 78 to collar 30. Additionally, in an example, the interfaces between races 88, 90 and races 108, 110 are coincident with an outer surface of a space and represented by sphere S (shown in dashed outline). Further in this example, sphere S is bisected by a plane P in which O-ring 84 is disposed. A retention ring 112 coaxially threads to an inner surface of a lower end of the collar 30. While a portion of retention ring 112 is circumscribed by the collar 30, a lower portion projects axially downward from the lower terminal end of collar 30. Axially set lower from races 108, 110 is a seal sleeve 114 that provides a lower seal between collar 30 and drive shaft 78. Seal sleeve 114 circumscribes the portion of the retention ring 112 that extends past the lower end of collar 30. Circumscribed by retention ring 112 is an annular bellows assembly 116, which is made up of a bellows 118. In the illustrated example bellows 118, is a thin-walled member with walls that are undulating along its length to thereby allow for axial movement as well as pivoting, and yet still maintain a seal between the drive shaft 78 and collar 30. Also included with the bellows assembly 116 is a bellows nut 119 that couples to a lower end of bellows 118.

Figure 8:
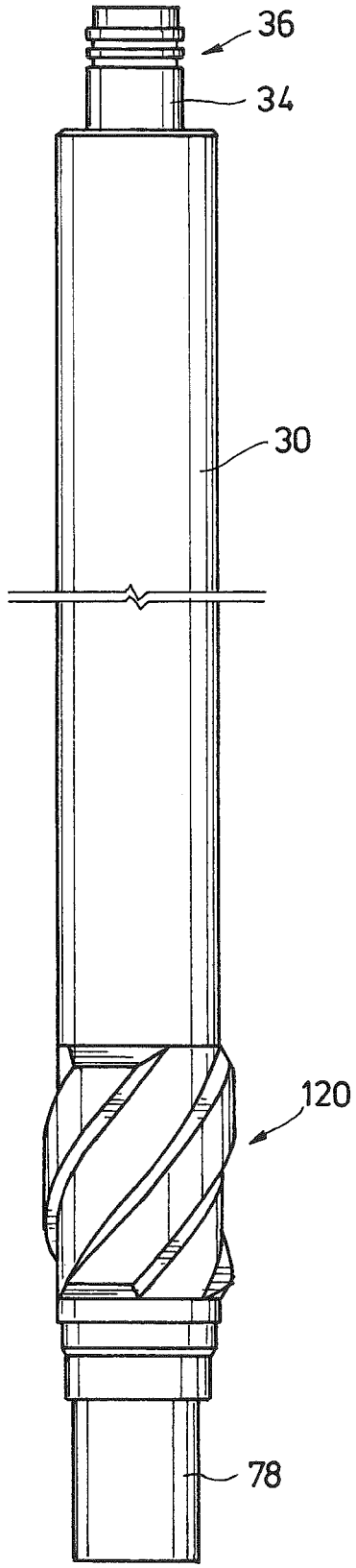
FIG. 8 is a side view of an example of a steering collar for use with the steering unit assembly of FIG. 2.

Shown in a side view in FIG. 8 is one example of collar 30 with drive shaft 78 projecting axially from one end, and housing 34 extending axially outward from an opposite end. In this example, a stabilizer 120 is shown on the outer surface of collar 30, and which is made up of some raised portions that are spaced circumferentially apart and wherein each portion follows a generally, helical pattern along the outer surface of collar 30. Stabilizer 120 provides a spacing between the collar 30 and inner surface of wellbore 12 (FIG. 1A) to provide protective separation between the two.

In one example of operation, as shown in FIGS. 1A-1C and FIG. 2, drill string 16 has an upstream end depending from drilling rig 122. A top drive or rotary table 124 provides a rotational force onto the drill string that in turn rotates SUA 18. Rotating SUA 18 provides a rotating force onto the outer surface of collar 30, that via splines 94, 98 and drive shaft 78, causes receptacle 79 to rotate, and thus installed drill bit 24 to rotate as well. To form the bend 26 of FIG. 1C, motor assembly 59 is selectively activated to rotate rotor 60, that as described above rotates orientation sleeve 72. As orientation sleeve 72 rotates, the obliquely oriented and axially offset bore 74 moves drive shaft 78 in a precession-like motion with respect to drill string 16 and collar 30. Further in this example, orientation sleeve 72 is rotated at a designated rotational velocity, and in a direction opposite to that of collar 30, to maintain the drive shaft 78 in a designated inclination and azimuthal orientation as the drill string 16 and collar 30 rotate. Knowing a designated inclination and azimuthal position, the bend 26 and deviated wellbore 27 are formed as described above. An advantage of the crown in the splines allows continued rotational motion transfer between collar 30 and drive shaft 78 even during pivoting of the drive shaft 78; thereby causing the respective spline members 96, 100 to move axially with respect to one another. In an example of operation, the drive shaft 78 (and bit 24) is obliquely oriented with respect to collar 30, by rotating orientation sleeve 72 in an angular direction opposite the rotational direction of drill string 16; but at the same angular rotational rate as drill string 16. In an example, drill bit 24 direction is changed by rotating the orientation sleeve 72 in an angular direction opposite the drill string 16, but at an angular rate of rotation that is different from that of the drill string 16.

Figure 9A:
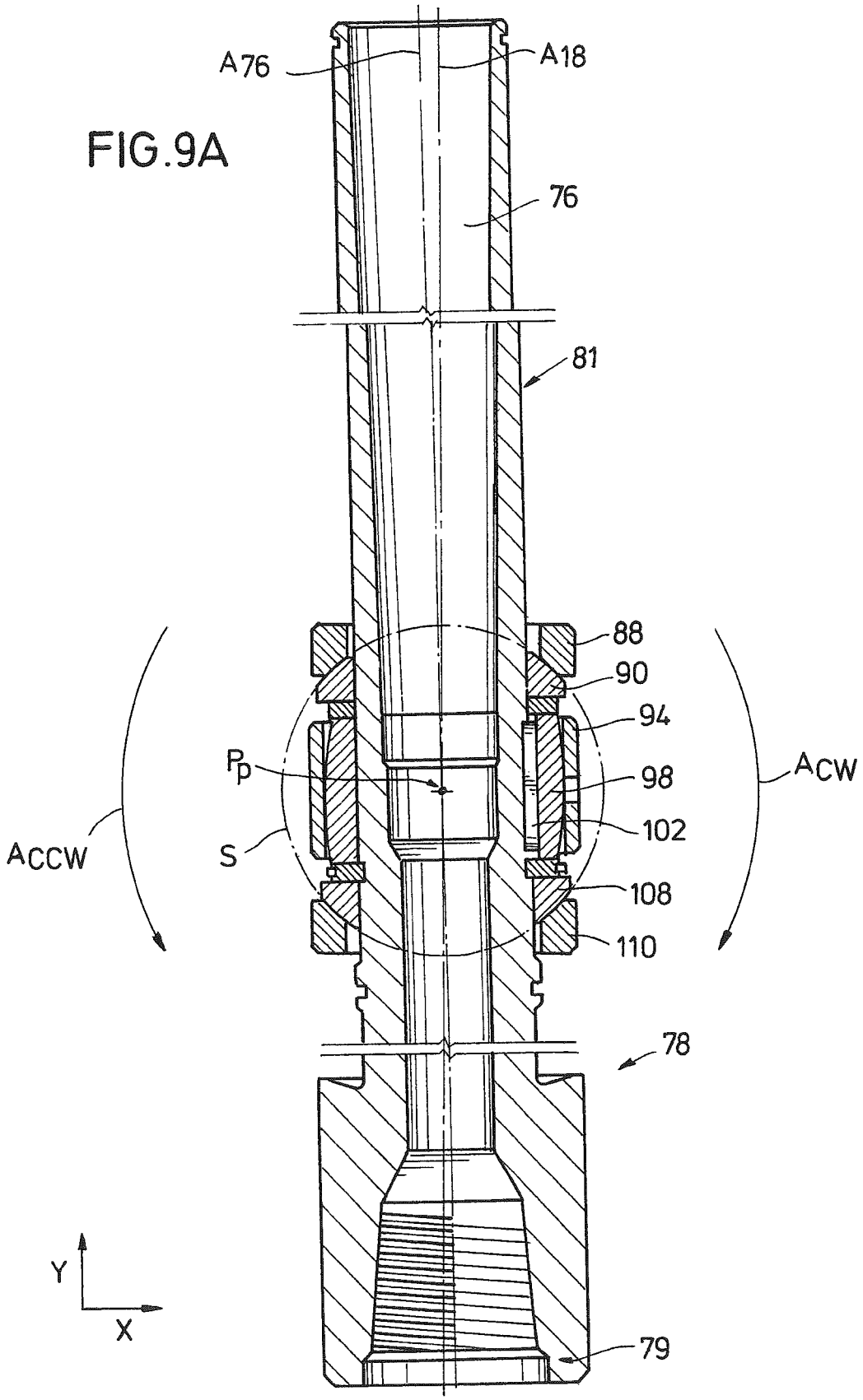
FIGS. 9A and 9B are side sectional views of examples of a drive shaft for use with the steering unit assembly of FIG. 2 respectively pivoted into different orientations.
Figure 9B:
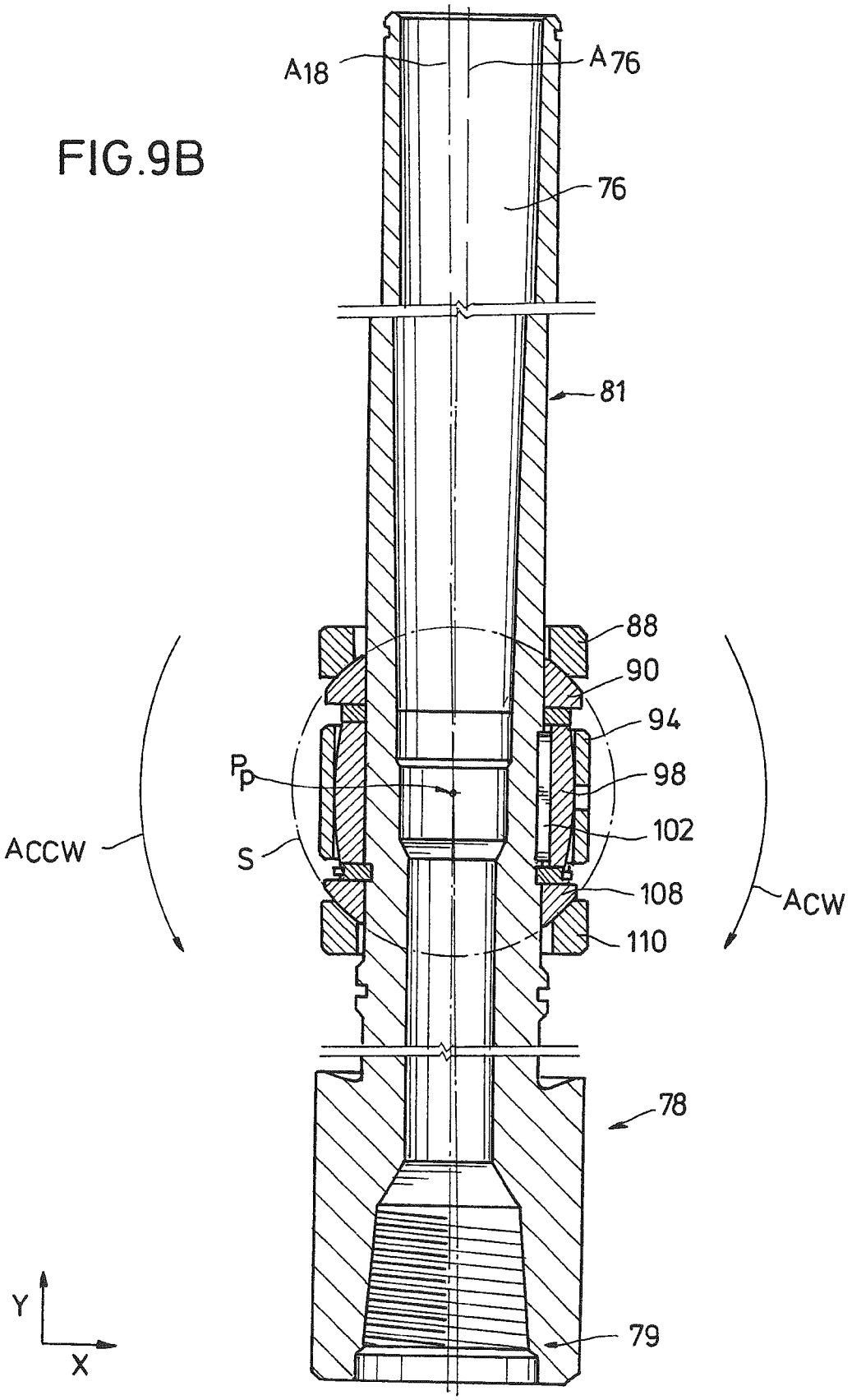

Shown in side sectional views in FIGS. 9A and 9B are examples of the drive shaft 78 pivoting between different orientations. Pivoting drive shaft 78 in a clockwise direction, as illustrated by arrow $A_{CW}$, changes the orientation of the drive shaft 78 of FIG. 9A to that of FIG. 9B. Similarly, pivoting drive shaft 78 in a counter-clockwise direction, as illustrated by arrow $A_{CCW}$, changes the orientation of the drive shaft 78 of FIG. 9B to that of FIG. 9A. In each of FIGS. 9A and 9B, axis $A_{76}$ of bore 76 is oblique with axis $A_{18}$ of steering unit assembly 18 (FIG. 2). In the examples of FIGS. 9A and 9B, axes $A_{76}$, $A_{18}$ are angularly offset from one another at the opening of the shroud 81, and proximate the receptacle 79. However, the order of axes $A_{76}$, $A_{18}$ changes between the pivoted orientations illustrated in FIGS. 9A and 9B. For example, axis $A_{18}$ is closer than axis $A_{76}$ to the Y-axis of the Cartesian coordinates of FIG. 9A proximate the opening of bore 76; but axis $A_{18}$ is spaced farther away from the Y-axis than axis $A_{76}$ proximate the opening of bore 76. Depicted in FIGS. 9A and 9B the axes $A_{76}$, $A_{18}$ intersect one another at pivot point P; thereby indicating a point or axis about which drive shaft 78 rotates while being pivoted. Pivot point $P_P$ is at the center of sphere S (and in plane P); as described above the outer surface of sphere S is coincident with interfaces between races 88, 110 and races 90, 108.

Figure 10A:
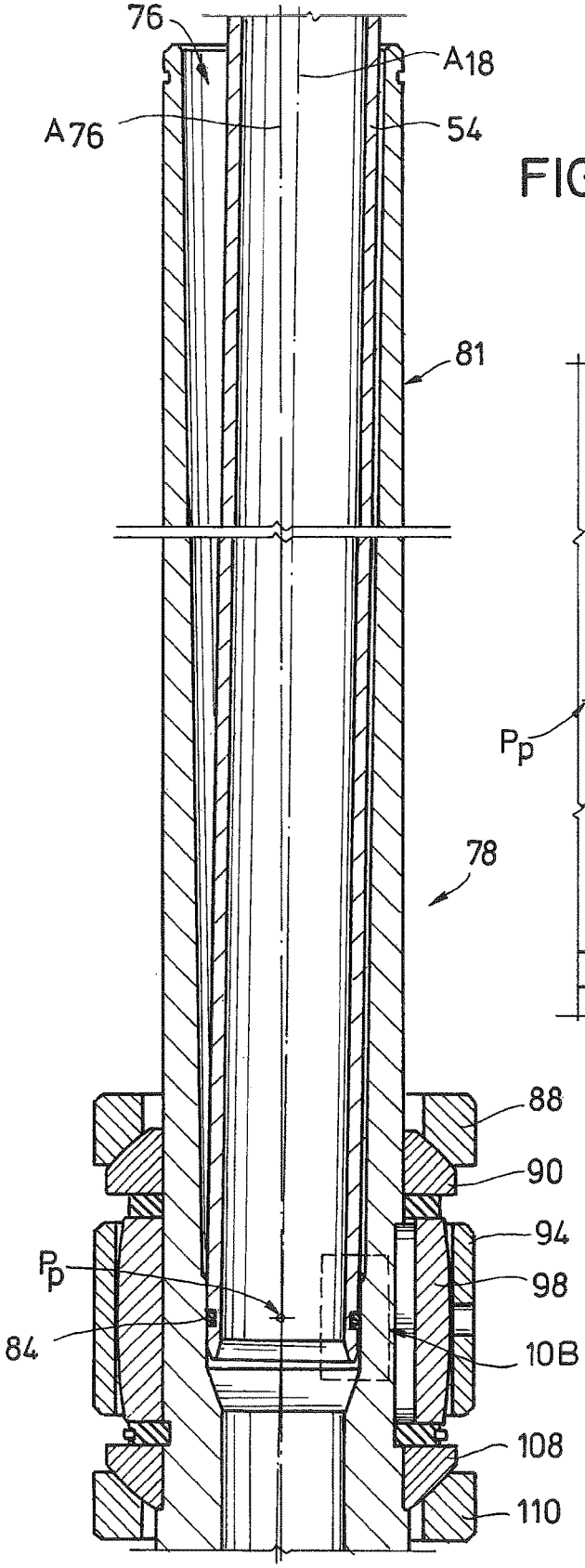
FIGS. 10A and 11A are side sectional views of the drive shaft of FIGS. 9A and 9B respectively with an example of an associated flow tube.

FIG. 10A is a side sectional view of an example of the drive shaft 78 having substantially the same orientation as that of FIG. 9A and so that axis $A_{76}$ of bore 76 is lower on the Y-axis than axis $A_{18}$ of the steering unit assembly 18 (FIG. 2). Also shown in FIG. 10A is flow tube 54 inserted into bore 76 and in sealing contact with an inner surface of bore 76. In this example, flow tube 54 remains substantially aligned with axis $A_{18}$, and thus drive shaft 78 is pivotable with respect to flow tube 54. As indicated above, the diameter of bore 76 increases with distance from end 83 so that the sidewalls of the bore 76 remain clear of the flow tube 54 as the drive shaft 78 pivots in response to rotation of sleeve 72 (FIG. 2). Thus the presence of flow tube 54 inside bore 76 does not interfere with drive shaft 78 pivoting.

Figure 10B:
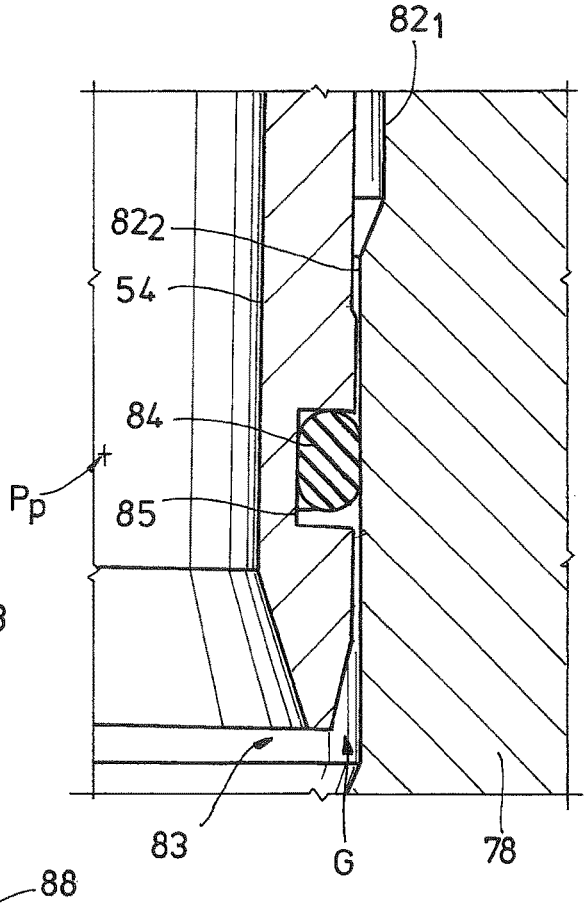
FIGS. 10B and 11B are side sectional and enlarged views of portions of FIGS. 10A and 11A respectively, and where an O-ring is disposed between the flow tube and drive shaft.
Figure 11A:
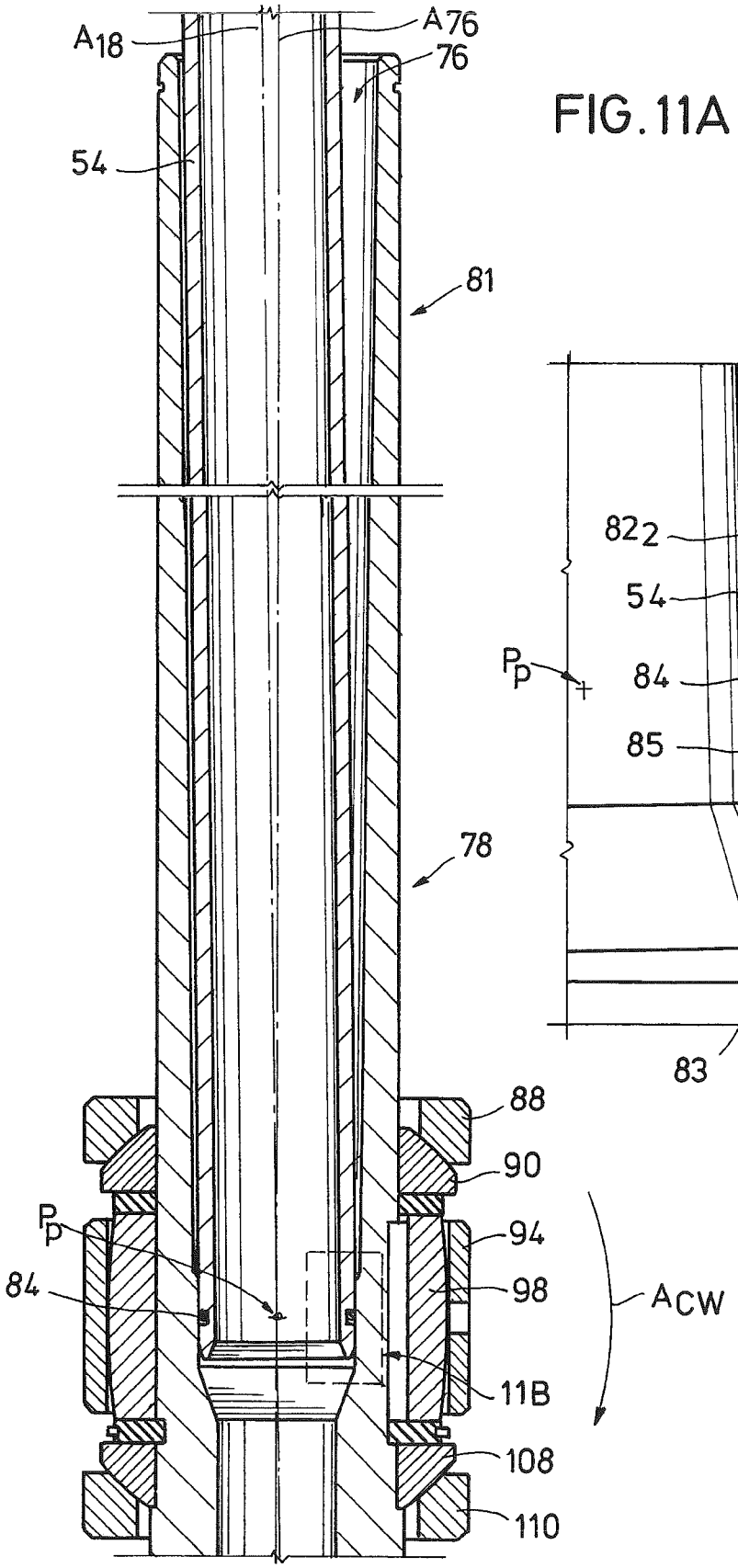
Figure 11B:
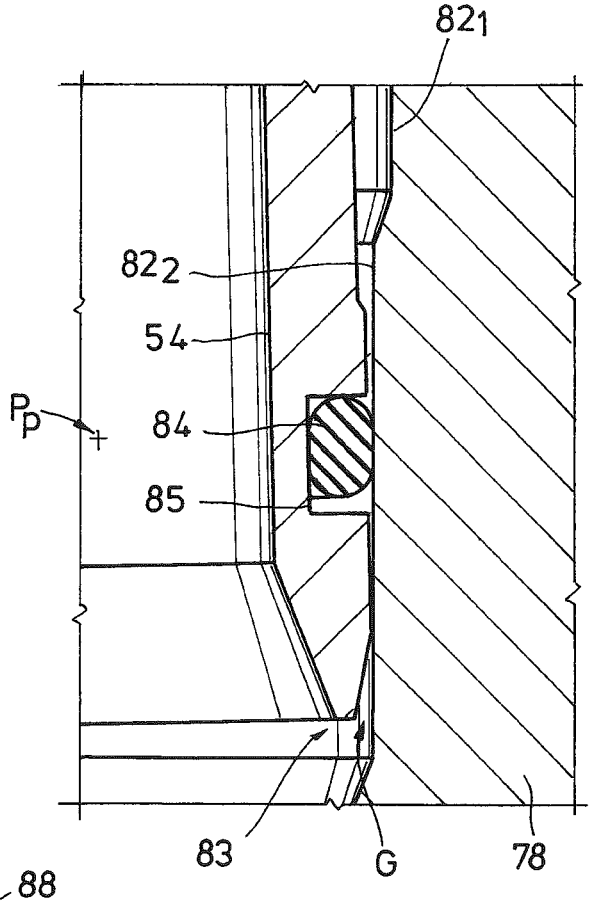

FIG. 10B illustrates in side sectional and enlarged view a portion of an example of flow tube 54 proximate its end 83 and inserted into drive shaft 78. As depicted in the example of FIG. 10B, while the outer surface of flow tube 54 remains clear of drive shaft 78, O-ring 84 is shown in sealing contact with flow tube 54 inside of recess 85, extending across a gap G between flow tube 54 and drive shaft 78, and into sealing contact with the profile $\mathbf{82}_2$ formed along bore 76 in drive shaft 78. As shown, the outer surface of flow tube 54 upstream of O-ring 84 is closer to the sidewalls of bore 76 than that downstream of O-ring 84. In the illustrated embodiment, because O-ring 84 (and recess 85) is strategically located proximate end 83, the sealing interface formed by O-ring 84 between flow tube 54 and drive shaft 78 operates as a "static seal." In an example a static seal provides a flow and a pressure barrier between surfaces that have little to no movement relative to one another. As illustrated in the example of FIGS. 11A and 11B, drive shaft 78 has swiveled, so that when viewed in cross section, the drive shaft 78 appears to have pivoted in a clockwise direction so that the relative radial location of axes $A_{18}$, $A_{76}$ has changed over that of FIGS. 10A and 10B, thereby bringing the surface of flow tube 54 that is downstream of O-ring 84 closer to the inner surface of bore 76 than the surface of flow tube 54 upstream of O-ring 84. Referring now to FIGS. 10B and 11B, in the illustrated example of operation, FIG. 10B depicts the drive shaft 78 in its farthest counter-clockwise pivot, and in FIG. 11B, the drive shaft 78 is shown in its farthest clockwise pivot; thus comparing FIGS. 10B and 11B the drive shaft 78 is shown in orientations describing its full range of pivoting motion. Further illustrated is how there is little to no axial movement between O-ring 84 and recess 85 or between O-ring 84 and profile $\mathbf{82}_2$. Further an annular gap G is shown between the outer surface of flow tube 54 and profile $\mathbf{82}_2$, where the thickness of gap G on opposite sides of recess 85 changes between the counter-clockwise and clockwise pivot positions of the drive shaft 78 illustrated in FIGS. 10B and 11B. Example thicknesses of gap G range from about 0.005 inches to about 0.015 inches.

Figure 12:
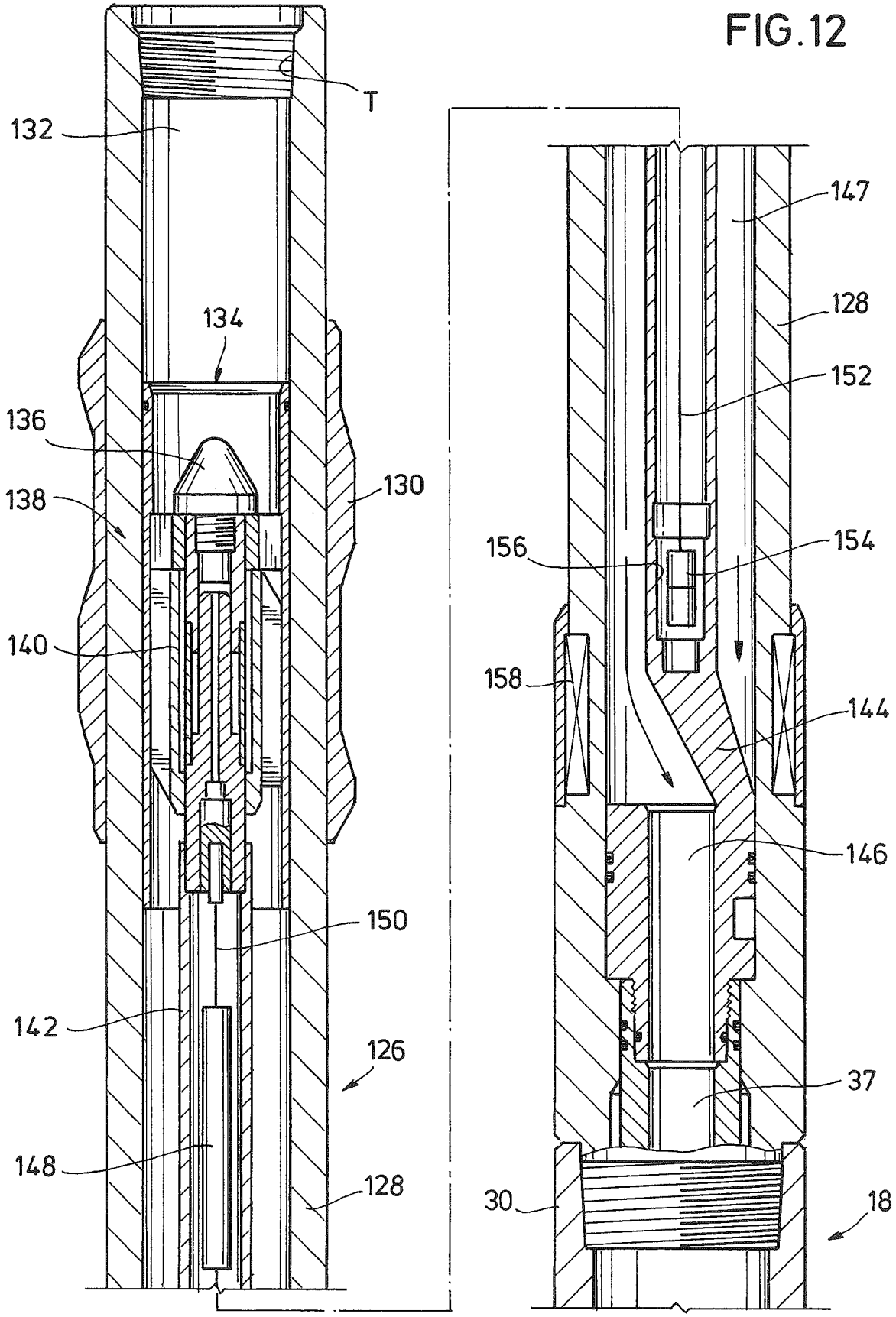
FIG. 12 is a side sectional view of an example of a control unit assembly that selectively mounts to an upstream end of the steering unit assembly of FIG. 2.

Illustrated in side sectional view in FIG. 12 is an example of a control unit assembly 126 that is optionally included with the steering unit assembly 18. Control unit assembly 126 includes an annular control collar 128 has an end shown coupled with an end of collar 30 of steering unit assembly 18. In the illustrated example, collar 128 provides an outer covering for components within the control unit assembly 126. Further, threads T are provided on an end of collar 128 distal from where it is coupled with collar 30. In an embodiment, an end of drill string 16 distal from drilling rig 122 (FIG. 1) couples with threads T. As such, in the example of FIG. 12, rotational energy from drill string 16 rotates control collar 128, which in turn rotates collar 30. As discussed above, rotating collar 30 ultimately produces rotation of drill bit 24 (FIGS. 1A-1C). An optional stabilizer 130 is shown mounted on an outer surface control collar 128 for use in stabilizing assembly 126 during drilling operations. A bore 132 is formed within control collar 128 and in which a generator assembly 134 is disposed. In the example of FIG. 12, electricity is generated by generator assembly 134, which is used to power components within and associated with drilling assembly 10 (FIG. 1). An upstream end of generator assembly 134 is equipped with a frusto-conically shaped bullnose 136 for diverting fluid (such as drilling mud) flowing through bore 132 towards blades of an impeller assembly 138 disposed downstream of bullnose 136. In one example of operation, directing fluid flow past the impeller assembly 138, rotates impellers and an associated shaft in the assembly 138, that in turn rotates a rotor 140 disposed in a magnetic field thereby generating electricity. An elongate annular pressure housing 142 is shown downstream of generator assembly 134; and having an end distal from generator assembly 134 that terminates at an upstream end of a flow diverter 144. A bore 146 is shown formed axially through a downstream portion of flow diverter 144. Bore 146 is in communication with an upstream end of annular space 37, so that fluid flowing in annulus 147 between collar 128 and pressure housing 142 is directed through bore 146 and into annular space 37.

Electricity generated within generator assembly 138 is directed to power and control electronics 148 via line 150. In an example, electricity from generator assembly 138 is conditioned by power and control electronics 148 so that the electricity is usable by components within the drilling assembly 10 (FIG. 1). In an embodiment, conditioning of the generated electricity includes rectifying the current, and/or adjusting values of voltage/current to match operational specifications of the user components. Line 152 transmits the conditioned electricity from power and control electronics 148 to an electrical connector 154, that in an example is rotatable. Power and control electronics 148 and lines 150, 152 are disposed within pressure housing 142, whereas connector 154 is housed in cavity 156 formed in an upstream portion of flow diverter 144. An optional antenna 158 is shown formed on an outer surface of collar 128, wherein antenna 158 is used for communicating signals uphole or to surface, where the signals optionally include data from sensors disposed downhole, or control commands for directing operation of the drilling assembly 10.

Figure 13A:
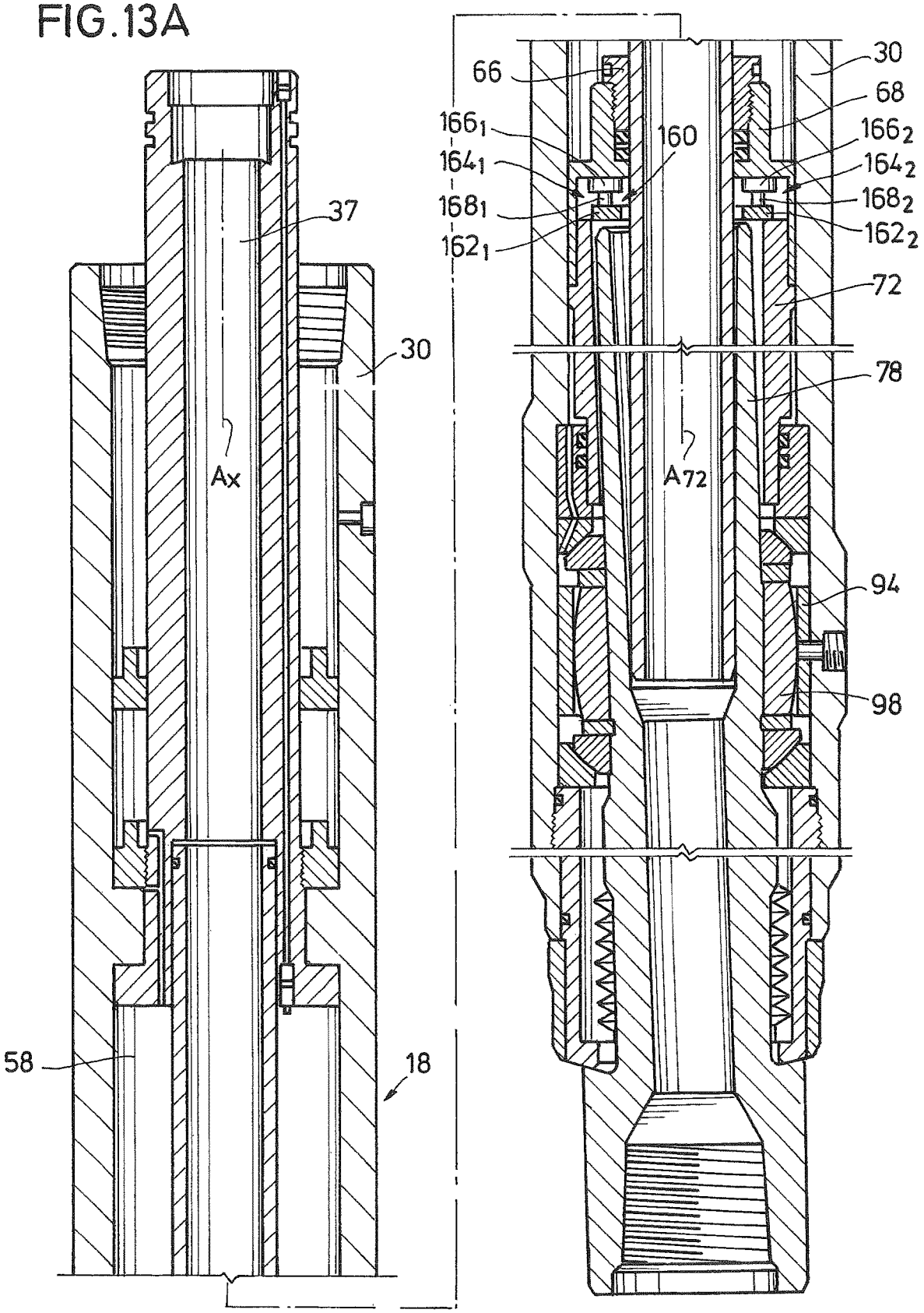
FIGS. 13A and 14A are side sectional views of embodiments of the steering unit assembly of FIG. 2, each having a brake assembly.

In an alternative example of operation, the drill string 16 (FIG. 1A) is steered by impeding or stopping rotation of the orientation sleeve 72. Illustrated in FIGS. 13A/B, 14A/14B are examples of a brake assembly 160, 160A for impeding or stopping rotational motion of the orientation sleeve 72. Referring now to FIG. 13A, shown in a side sectional view is an example of SUA 18 having a brake assembly 160 disposed between an end of orientation sleeve 72 and the tube positioner 68. In this embodiment, the orientation sleeve 72 is positioned at a designated azimuth, about its axis $A_{72}$, by selectively actuating brake assembly 160. In the illustrated example, brake assembly 160 includes a brake pads $\mathbf{162}_{1,2}$ that are selectively urged in an axial direction and against orientation sleeve 72 by actuators $\mathbf{164}_{1,2}$. Actuators $\mathbf{164}_{1,2}$ of FIG. 13A each include a base $\mathbf{166}_{1,2}$ and a rod $\mathbf{168}_{1,2}$ that reciprocate from a respective base $\mathbf{166}_{1,2}$. In an example, hydraulic fluid is contained in each base $\mathbf{166}_{1,2}$ that when pressurized deploys rod $\mathbf{168}_{1,2}$ axially away from base $\mathbf{166}_{1,2}$ and urges brake pads $\mathbf{162}_{1,2}$ into interfering contact with sleeve 72. In an alternative, brake assembly 160 is electrically powered; and electrically powered motive devices, such as a motor or solenoid (not shown) are disposed in each base $\mathbf{166}_{1,2}$, and which selectively exert a force onto the rod $\mathbf{168}_{1,2}$ that is transferred to sleeve 72 via pads $\mathbf{162}_{1,2}$.

Figure 13B:
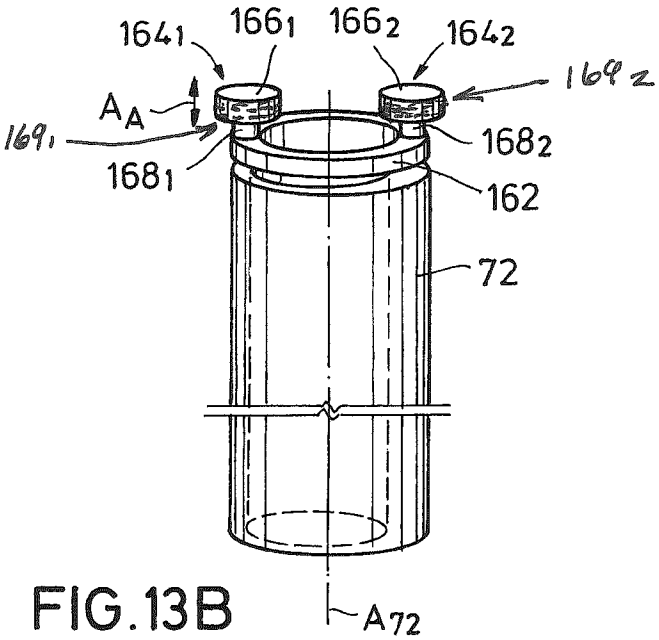

Shown in perspective view in FIG. 13B is a schematic example of an alternate example of the brake assembly 160 having a single brake pad 162. In this example, pad 162 is as shown is a generally planar and ring-like member. Actuators $\mathbf{164}_{1,2}$ are illustrated disposed at different angular locations about the axis $A_{72}$ of the orientation sleeve 72, and oriented with their respective rods $\mathbf{168}_{1,2}$ facing the brake pad 162. Energizing actuators $\mathbf{164}_{1,2}$ urges brake pad 162 axially into contact with the orientation sleeve 72. Arrow $A_A$ illustrates an example of a reciprocating direction of pad 162. The embodiments of FIGS. 13A and 13B optionally include a motor assembly for rotating orientation sleeve 72. In an alternative embodiment, coils $\mathbf{169}_{1,2}$, which are schematically represented in dashed outline, become selectively energized for causing the reciprocating action of rods $\mathbf{168}_{1,2}$ to impart motion to pad 162.

Figure 14B:
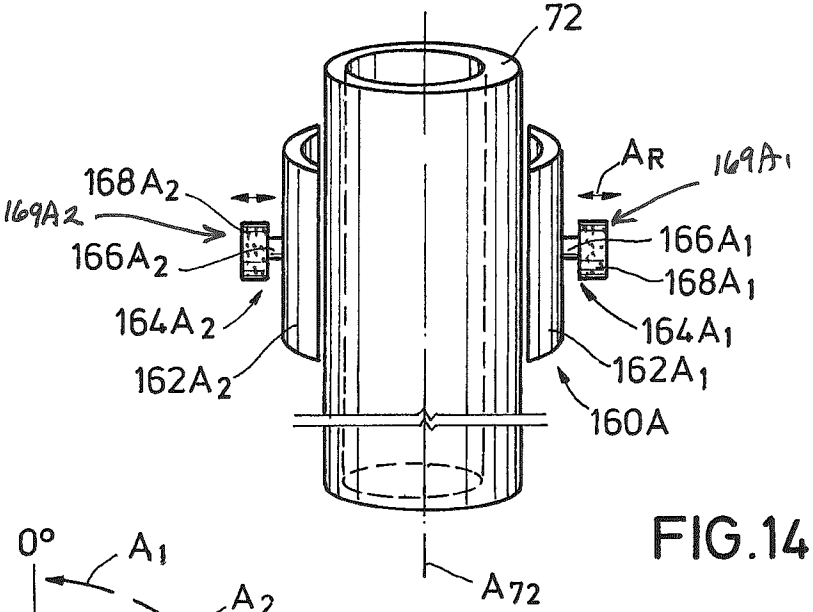
FIGS. 13B and 14B are perspective views of portions of the steering unit assemblies of FIGS. 13A and 14A respectively.
Figure 14A:
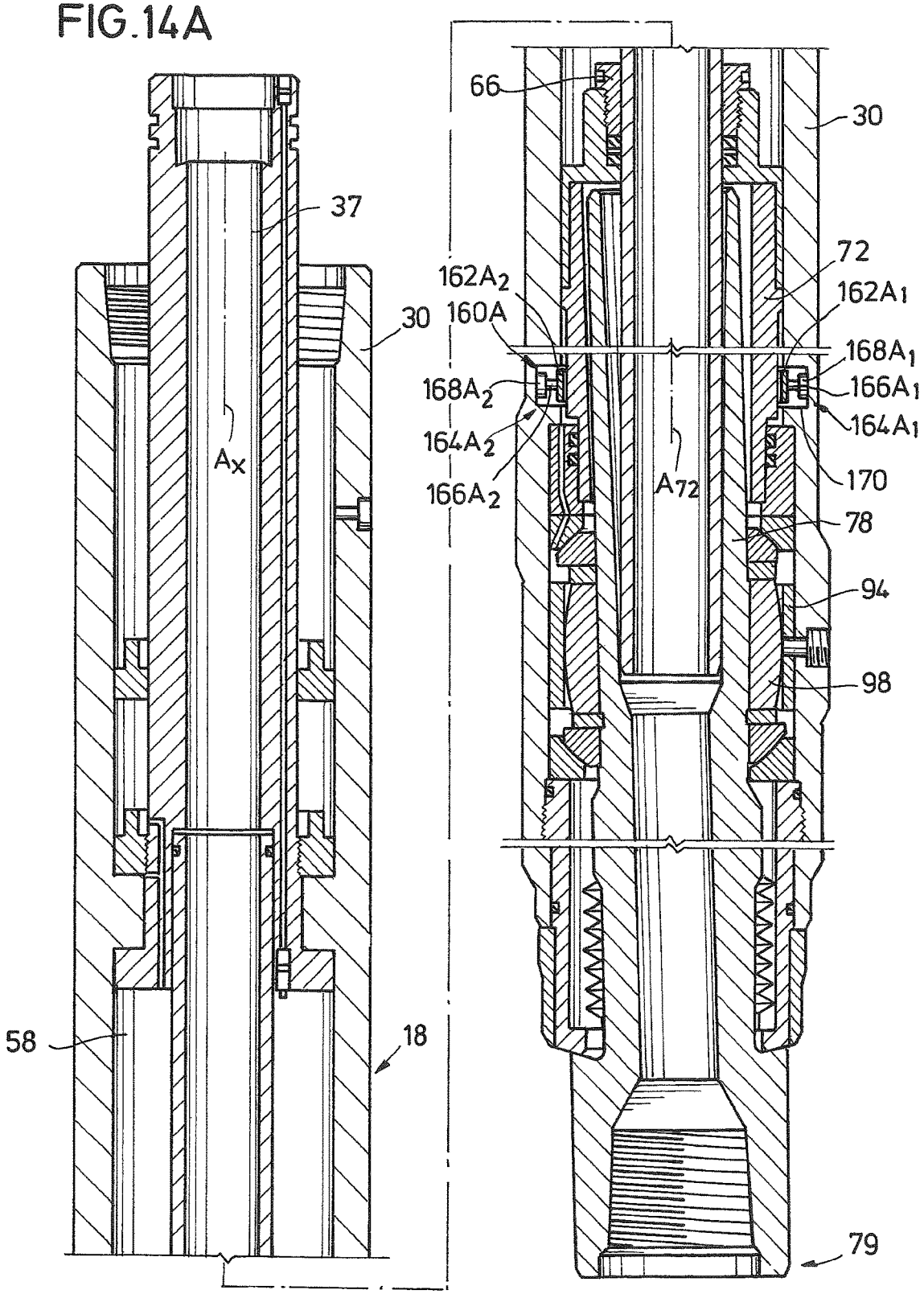

An alternate example of the brake assembly 160A is shown in a side sectional view in FIG. 14A. In this example the actuators $\mathbf{164}A_{1,2}$ and pads $\mathbf{162}A_{1,2}$ are set radially outward from the orientation sleeve 72 and disposed in an optional recess 170 shown circumscribing sleeve 72 and formed along an inner surface of the collar 30. In the example of FIG. 14A, energizing brake assembly 160 urges the pads $\mathbf{162}A_{1,2}$ radially inward and into frictional engaging contact with an outer surface of the orientation sleeve 72. Illustrated in FIG. 14B is an example of the brake assembly 160A and orientation sleeve 72; and depicted in a perspective view. As shown, the pads $\mathbf{162}A_{1,2}$ are curved along a path circumscribing orientation sleeve 72, and generally linear along a path parallel with axis $A_{72}$. Inner radial surfaces of pads $\mathbf{162}A_{1,2}$ are shaped similar to that of the outer surface of the orientation sleeve 72. Further in the embodiment of FIG. 14B, actuators $\mathbf{164}A_{1,2}$ are disposed radially outward from pads $\mathbf{162}A_{1,2}$ and oriented with rods $\mathbf{168}A_{1,2}$ on each base $\mathbf{166}A_{1,2}$ facing the pads $\mathbf{162}A_{1,2}$, so that extending the rods $\mathbf{168}A_{1,2}$ urges the pads $\mathbf{162}A_{1,2}$ radially inward and into contact with the outer surface of sleeve 72. Arrows $A_R$ illustrate an example of a reciprocating directions of pad $\mathbf{162}A_{1,2}$. Schematically represented in dashed outline are coils $\mathbf{169}A_{1,2}$, which are optionally included with the embodiment of FIG. 14B, and that when selectively energized cause a reciprocating action of rods $\mathbf{168}A_{1,2}$ to urge pads $\mathbf{162}A_{1,2}$ radially inward and outward.

Figure 15:
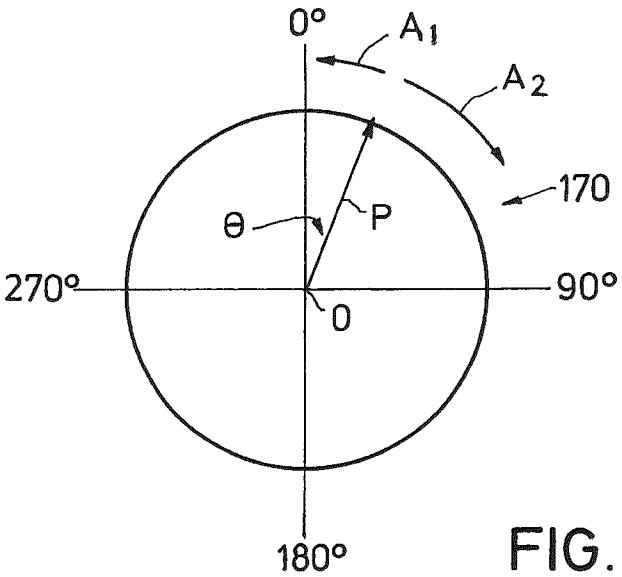
FIG. 15 is a schematic depiction of a path of a drill bit coupled with a steering unit assembly having a brake assembly.

A chart 170 is provided in FIG. 15, and which schematically depicts a path P of drill bit 24 (FIG. 1A) through formation 14 at a point in time. Also included in chart 170 is a reference grid having polar values ranging from 0° to 360°, and which represent a direction about an origin O. Examples exist where the path P represents travel of the drill bit 24 in vertical, horizontal, or deviated wells. In the example of FIG. 15, a designated path has been established for the drill bit 24 which coincides with polar value of 0°. Embodiments exist where the designated path is based on a planned or designed placement of a wellbore; so that guiding a drill bit along the designated path forms the wellbore as specified. As illustrated, the actual travel of drill bit 24 is along path P, and is at an angle θ with respect to the designated travel. In some embodiments angle θ also corresponds to an angular offset between reference points set respectively on outer surfaces of the orientation sleeve 72 and drill collar 30 (FIG. 13A); and that occurs at a point in time as these members are rotating.

In examples when the orientation sleeve 72 is actively rotated, such as by a motor as described above; and the drill bit 24 is traveling along path P and angularly offset from a designated or specified path, the drill bit 24 is steered back on course (so the path P is coincident with the designated path) by increasing angular velocity of orientation sleeve 72. Increasing angular velocity of orientation sleeve 72 causes it to be angularly reoriented with respect to collar 30, and in the direction of arrow $A_1$. In contrast, in examples of operating embodiments of the SUA 18 having a brake assembly 160, 160A (FIGS. 13A/B, 14A/B); brake assembly 160, 160A is engaged to retard rotational velocity of orientation sleeve 72. In this example, orientation sleeve 72 is angularly reoriented with respect to collar 30 in the direction of arrow $A_2$, which is a direction opposite that of $A_1$. As illustrated in this example, the orientation sleeve 72 and drill collar 30 rotate about same axis, or axes that are parallel with one another; so that the respective designated azimuths of the orientation sleeve 72 and drill collar 30 are aligned with relative rotation of these elements in opposite directions. Further in this example of operation, rotation of the orientation sleeve 72 is impeded or stopped for a set period of time, such as by engaging the brake assembly 160, 160A, until particular azimuthal locations of the orientation sleeve 72 and collar 30 are aligned or substantially aligned. In an example, the position, orientation, inclination, or any other spatial designation of the drill string 18 is obtained or obtainable by one or more of a magnetometer, gyroscope, accelerometer, similar instruments, and combinations thereof. In one example, the time to actuate the brake 160, 160A for aligning the sleeve 72 and collar 30 is calculated based on the angle θ and the angular rotational rate. Further in this example, the angle θ is estimated by monitoring the drill bit 24 location.

Not to be bound by theory, but it is believed that the forces generated by excavating interaction of the drill bit 24 (FIG. 1A) with the formation 14 are transmitted through the drill bit 24 and drive shaft 78 (FIG. 2), and to the orienting sleeve 72. The forces which are applied to the face and lateral sides of the drill bit 24 generally resist changes to orientation or positioning of the drill bit 24 and drive shaft 78 as the drill bit 24 bores through the formation 14. Instead, as the collar 30 is rotatable with respect to orienting sleeve 72, the forces retaining the drive shaft 78 also retain positioning of the orienting sleeve 72, and allow for relative rotation between the sleeve 72 and collar 30. An advantage of employing a brake to retard an orienting sleeve to steer the drill bit 24 instead of a motor to continuously rotate the orienting sleeve, is that a brake is simpler, less expensive, and less prone to failure.

The improvements described herein, therefore, are well adapted to carry out the objects and attain the ends and advantages mentioned, as well as others inherent therein. While example embodiments have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method of excavating in a formation comprising:

operating a steerable earth boring assembly that comprises, an annular collar, a drive shaft rotationally coupled to the annular collar, a drill bit mounted to a downstream end of the drive shaft, an orientation sleeve having a bore that extends oblique to an axis of the drive shaft, and in which receives an end of the drive shaft distal from the drill bit;

rotating the drive shaft and drill bit by rotating the collar;

monitoring a path of the drill bit; and adjusting the path by retarding rotation of the orientation sleeve with a lateral force applied to an outer surface of the orientation sleeve.

2. The method of claim 1, wherein the lateral force is applied for a period of time, and where the period of time relates to a rotational rate of the collar.

3. The method of claim 1, wherein a direction of the path is adjusted.

4. The method of claim 1, wherein an inclination of the path is adjusted.

5. The method of claim 1, wherein the steerable earth boring assembly further comprises a brake, and wherein the brake is urged into contact with the orientation sleeve to retard rotation of the orientation sleeve.

6. The method of claim 1, further comprising removing the lateral force.

7. The method of claim 1, wherein the steerable earth boring assembly further comprises a motor that is coupled to the orientation sleeve, and wherein the motor comprises a stator, coils in the stator, a rotor circumscribing the stator and which is coupled to the orientation sleeve, the method further comprising rotating the rotor by energizing the coils.

8. A steerable earth boring assembly comprising:

an annular collar that is selectively rotationally coupled to a drill string;

an orientation sleeve having an axis and a bore that extends along a path oblique to the axis;

a drive shaft rotationally coupled to the collar and that comprises, a downstream end, and an upstream end that is inserted into the bore in the orientation sleeve;

a drill bit mounted in the downstream end; and a brake assembly having a pad that is selectively extended into contact with an outer surface of the orientation sleeve.

9. The steerable earth boring assembly of claim 8, wherein a lateral force is applied to the orientation sleeve by the pad and which changes a relative rate of rotation between the collar and the orientation sleeve.

10. The steerable earth boring assembly of claim 8, wherein the pad is urged axially against an end of the orientation sleeve.

11. The steerable earth boring assembly of claim 8, wherein the pad is urged radially against an outer circumference of the orientation sleeve.

12. The steerable earth boring assembly of claim 8, wherein the brake assembly is electromagnetically powered.

13. The steerable earth boring assembly of claim 8, further comprising a motor that is rotationally coupled with the orientation sleeve.

14. The steerable earth boring assembly of claim 13, wherein the motor comprises a stator, a coil in the stator, and a magnetic rotor that circumscribes the stator and that are coupled to orientation sleeve, so that when the coil is energized, the rotor rotates with respect to the stator and causes the orientation sleeve to rotate.

* * * * *